US005372984A

United States Patent [19]

Yamauchi et al.

[11] Patent Number: 5,372,984

[45] Date of Patent: Dec. 13, 1994

[54] THERMOSENSITIVE RECORDING MATERIAL

[75] Inventors: Hiroshige Yamauchi, Yokohama; Hideaki Shinohara, Tokyo; Shuji Saito; Ken Kanazawa, both of Yokohama, all of Japan

[73] Assignee: New Oji Paper Co., Ltd., Tokyo, Japan

[21] Appl. No.: 113,903

[22] Filed: Aug. 31, 1993

Related U.S. Application Data

[63] Continuation-in-part of Ser. No. 890,826, Jun. 1, 1992, abandoned.

[30] Foreign Application Priority Data

Jun. 12, 1991 [JP] Japan ..... 3-166155

[51] Int. Cl.[5] ..... B41M 5/40

[52] U.S. Cl. ..... 503/200; 427/152; 503/226

[58] Field of Search ..... 503/200, 226; 427/152

[56] References Cited

U.S. PATENT DOCUMENTS 4,370,370 1/1983 Iwata et al. ..... 428/40
5,122,413 6/1992 Ohno et al. ..... 503/200
5,141,914 8/1992 Kang ..... 503/226

FOREIGN PATENT DOCUMENTS 0345419 12/1989 European Pat. Off. .
0356904 3/1990 European Pat. Off. .
2094495 9/1982 United Kingdom .

*Primary Examiner*—Pamela R. Schwartz
*Attorney, Agent, or Firm*—Armstrong, Westerman, Hattori, McLeland & Naughton

[57] ABSTRACT

A thermosensitive recording material having a high resistance to curling and cockling when colored images are developed thereon comprises a substrate sheet comprising a thermoplastic resin and having a thermal shrinkage of 1.0% to 2.0% at a temperature of 120° C.; a thermosensitive colored image-forming layer formed on a surface of the substrate sheet and comprising a colorless dye precursor, a color-developing agent and a binder; a backcoat layer formed on the opposite surface of the substrate sheet, having a weight of 1 to 10 g/m$^2$ and comprising 20 to 90 parts by weight of a water-soluble polymeric material 10 to 80 parts by weight of a water-isoluble polymeric material and 1 to 10 parts by weight of a cross-linking agent for the water-soluble polymeric material; and optionally, an overcoat layer formed on the thermosensitive colored image-forming layer and comprising a pigment and binder resin.

11 Claims, No Drawings

THERMOSENSITIVE RECORDING MATERIAL

This application is a continuation-in-part application of application Ser. No. 07/890,826, filed on Jun. 1, 1992, now abandoned.

BACKGROUND OF THE INVENTION

1. Field of the Invention

The present invention relates to a thermosensitive recording material. More particularly, the present invention relates to a thermosensitive recording material useful for a thermosensitive plotter for outputting a drawing prepared in a computer-aided design (CAD) system, and for a thermosensitive image-printer for outputting CRT images as a hard copy in a medical measurement.

2. Description of the Related Arts

It is known that a conventional thermosensitive recording material comprises a substrate material, for example, a paper sheet, synthetic paper sheet or plastic resin film, and a thermosensitive colored image-forming layer formed on a surface of the substrate material and comprising, as main components, a substantially colorless dye precursor consisting of, for example, an electron-donative leuco basis dye; a color-developing agent consisting of an electron-acceptive organic acid compound, for example, a phenolic compound; and a binder, and that the colored recording images can be created on the colored image-forming layer by reacting the dye precursor with the color-developing agent upon applying heat thereto.

This type of thermosensitive recording material is advantageous in that the recording apparatus can be made relatively compact and small size at a low cost, and can be easily maintained, and thus is widely utilized not only as a recording medium for facsimile machines and automatic ticket-vending machines, but also as an outputting medium for various printers and plotters of colored images of POS labels, CAD images and CRT medical images.

Also, it is known that a synthetic paper sheet having a multi-layer structure, and a bi-axially drawn thermoplastic resin film optionally containing an inorganic pigment, are utilized as a recording material that must have a high water-resistance and tensile strength, or as a recording material for a printer used with a CRT medical measurement apparatus that must record colored images with a high uniformity and resolving power, or as a recording material for a CAD plotter that must record colored images with a high dimensional stability and thin line images.

The conventional synthetic paper sheet having the multi-layered structure is produced by heat-kneading a polyolefin resin and a white inorganic pigment, extruding a melt of the resultant mixture through a film-forming die, drawing the resultant extruded sheet in a longitudinal direction thereof, laminating, on each of the two surfaces of the drawn sheet, one or two layers each consisting of a film formed from a mixture of a polyolefin resin with a white inorganic pigment and then drawing the resultant laminated sheet in a cross direction thereof.

The thermoplastic resin film is produced by extruding a melt of a thermoplastic resin comprising at least one member selected from, for example, polyolefin resins and polyester resins, through a film-forming die and then drawing the resultant extruded sheet biaxially, or by extruding a melt of a mixture of a thermoplastic resin with a white inorganic pigment through a film-forming die, and then drawing the resultant sheet biaxially.

Due to the above-mentioned processes, when a recording material consisting of a synthetic paper sheet with a multi-layer structure or the thermoplastic resin film is subjected to a thermosensitive recording procedure in which a thermal head is brought into contact with the recording material to record colored images at a high density, heat transmitted to a substrate material of the recording material causes the substrate material to be thermally shrunk and the recording material to be curled inward at the recorded face thereof, or to be cockled, and thus to exhibit an undesirable appearance.

SUMMARY OF THE INVENTION

An object of the present invention is to provide a thermosensitive recording material comprising a substrate sheet and a thermosensitive colored image-forming layer formed on a surface of the substrate sheet and exhibiting an excellent resistance to a creation of a curling or cockling thereof even when the substrate sheet is formed from a synthetic paper sheet having a multilayer structure or a thermoplastic resin film.

The above-mentioned object can be attained by the thermosensitive recording material of the present invention, which comprises, a substrate sheet comprising at least one member selected from the group consisting of thermoplastic resin films and synthetic paper sheets having a multilayer structure; a thermosensitive colored image-forming layer formed on a surface of the substrate sheet and comprising a substantially colorless dye precursor, a color-developing agent reactive with the dye precursor upon heating to develop a color, and a binder; and a backcoat layer formed on an opposite surface of the substrate sheet and comprising 20 to 90 parts by weight of a water-soluble polymeric material, 10 to 80 parts by weight of a water-insoluble polymeric material and 1 to 10 parts by weight of a cross-linking agent;

said substrate sheet exhibiting a thermal shrinkage restricted to a level of from 1.0% to 2.0% at a temperature of 120° C., and said backcoat layer having a weight of from 1 to 10 $g/m^2$.

DESCRIPTION OF THE PREFERRED EMBODIMENTS

The thermosensitive recording material comprises a substrate sheet comprising a thermoplastic resin, a thermosensitive colored image-forming layer formed on a surface of the substrate sheet, a backcoat layer formed on the opposite surface of the substrate sheet, and optionally, an overcoat layer formed on the thermosensitive colored image-forming layer.

The substrate sheet usable for the present invention comprises at least one member selected from the group consisting of thermoplastic resin films, which may be transparent, opaque or semitransparent, and synthetic paper sheets having a multilayer structure, which are preferably opaque or semitransparent, and preferably have a thickness of 50 to 500 μm.

The transparent thermoplastic resin film is produced, for example, by extruding a melt of a thermoplastic resin selected from the group consisting of polyethylene, polypropylene, ethylene-vinyl acetate copolymer, polyvinyl chloride, polystyrene and polyester resins and heat-mixtures of two or more of the above-mentioned resins, through a film-forming die, and biaxially drawing the resultant extruded film.

The opaque or semitransparent thermoplastic resin film can be produced from a mixture of a white inorganic pigment with the above-mentioned thermoplastic resin in the same manner as mentioned above. The opaque or semitransparent synthetic paper sheet is prepared, for example, by extruding a melt of a mixture of a polyolefin resin with a white inorganic resin through a film-forming die, drawing the resultant extruded film in the longitudinal direction thereof, laminating, on the two surfaces of the drawn film, one or two films comprising a mixture of a polyolefin resin with a white inorganic pigment, and then drawing the resultant laminated sheet in the cross direction thereof.

The synthetic paper sheet with a multilayer structure is available under the trademark of Yupo, grades of TPG (semitransparent type), KPK (semitransparent type), WST (semitransparent type), SGG (opaque type), FPG (opaque type), GFG (opaque type), WFP (opaque and thick type), WSF (opaque type) or WCF (opaque type), from OJI YUKA GOSEISHI K.K., or under the trademark of Toyopal (opaque type) from TOYOBO K.K..

In the thermosensitive recording material of the present invention, the substrate sheet has a thermal shrinkage restricted to a level of from 1 to 2% determined at a heating temperature of 120° C., and for a heating time of 30 minutes.

When a thermoplastic resin film or a synthetic paper sheet has a thermal shrinkage of 1 to 2% at a heating temperature of 120° C. for 30 minutes, the film or sheet can be employed to form a substrate sheet of the thermosensitive recording material of the present invention, without applying a shrinkage-reducing treatment. If the thermal shrinkage is more than 2%, this shrinkage can be reduced to a level of 1 to 2% by heat treating the thermoplastic film or synthetic paper sheet in the form of a wound roll at a temperature of 10° C. to 20° C. below the softening temperature thereof for a time of one day or more. By the above-mentioned heat treatment, a residual stress of shrinkage created by the above-mentioned drawing procedure is released.

In another heat treatment method, the thermoplastic resin film or synthetic paper sheet is continuously passed through a dryer of a coater at a temperature of 60° C. to 80° C. for a heating time of 10 to 60 seconds. In this method, the thermoplastic resin film or synthetic paper sheet must be tensed under a tension and heat-treated within a short time, and therefore, the heat-setting effect of this method is not always satisfactory. Therefore, the above-mentioned heat-treating method, in which the thermoplastic resin film or synthetic paper sheet is heat-treated in the form of a wound roll, is advantageous in that the shrinkage-reducing effect is satisfactory and the heat treatment cost is low.

The thermal shrinkage of the substrate sheet is determined in the following manner.

A substrate sheet is cut to provide a specimen having a length of 200 mm in the longitudinal or cross direction of the substrate sheet and a width of 15 mm in the cross or longitudinal direction of the substrate sheet.

The specimen is placed in a heating oven without restriction, heated at a temperature of 120° C. for 30 minutes, and then cooled to room temperature.

The shrinkage in the length of the specimen is calculated in accordance with the following equations:

$$\text{Shrinkage in length (\%)} = \frac{200 - L}{200} \times 100$$

wherein L represents a length in mm of the heat treated specimen.

The thermal shrinkage of the specimen is represented by a larger value of the shrinkages in the longitudinal and cross directions.

In the thermosensitive recording material of the present invention, a specific backcoat layer must be formed on a surface of a substrate sheet opposite to the surface thereof on which a thermosensitive colored image-forming layer is formed.

The backcoat layer comprises 20 to 90 parts by weight of a water-soluble polymeric material, 10 to 80 parts by weight of a water-insoluble polymeric material, which has been employed in the form of an aqueous emulsion or dispersion, and 1 to 10 parts by weight of a cross-linking agents, and optionally an additive selected from pigments and antistatic agents preferably in an amount of 60% or less based on the total dry weight of the backcoat layer.

The cross-linking agents are used to enhance the water-resistance of the backcoat layer. The pigments effectively prevent an undesirable blocking phenomenon of the backcoat layer. Also, the antistatic agents comprise at least one member selected from anionic and cationic electrolytic polymeric materials that effectively prevent an undesirable static electrification of the backcoat layer.

The backcoat layer has a weight of 1 to 10 g/m$^2$, and is formed by applying a coating liquid containing the above-mentioned materials to the opposite surface of the substrate sheet and drying the coating liquid layer. When dried, the coated liquid layer creates a strong shrinking force that causes the resultant thermosensitive recording material to be curled inwardly on the backcoat layer side.

Also, when a thermosensitive colored image-forming layer is formed on a front surface of the substrate sheet, a shrinking force is created in the resultant layer, to thus cause the resultant thermosensitive recording sheet to be curled inwardly on the thermosensitive colored image-forming layer side.

When the curling force created in the thermosensitive colored image-forming layer is balanced by the curling force created in the backcoat layer, the resultant thermosensitive recording material is released from the undesirable curling or cockling phenomenon.

When the weight of the backcoat layer is less than 1 g/m$^2$, the resultant backcoat layer cannot satisfactorily prevent the curling or cockling phenomenon of the resultant thermosensitive recording material.

When the weight of the backcoat layer is more than 10 g/m$^2$, the resultant thick backcoat layer hinders the coating and drying operations.

The backcoat layer comprises 20 to 90 parts by weight of a water-soluble polymeric material comprising, for example, at least one member selected from the group consisting of polyvinyl alcohol resins, starch, modified starches, gum arabic, gelatin, casein, chitosan, methyl cellulose, hydroxy-ethyl cellulose, hydroxy-methyl cellulose, polyvinyl pyrrolidone, polyacrylic acid salts, polyacrylamides, styrene-maleic anhydride copolymers, methylvinylether-maleic anhydride copolymers and isoprene-maleic anhydride copolymers, which have a satisfactory film-forming property.

To enhance the water-resistance of the backcoat layer, the water-soluble polymeric material is optionally employed together with a water-insoluble polymeric material comprising at least one member selected from the group consisting of, for example, vinyl acetate-acrylic acid ester copolymers, polyurethane resins, polyvinyl chloride resins, polyvinylidene chloride resins, methacrylic acid ester copolymers and acrylic acid ester copolymers usually employed in the form of an aqueous emulsion or dispersion, and exhibit a satisfactory film-forming property and a lowest film-forming temperature of 20° C. or less. The water-insoluble polymeric material is used in an amount of 10 to 80 parts preferably 10% to 70%, together with 20 to 90 parts by weight of the water-soluble polymeric material.

Also, to improve the water-resistance of the backcoat layer, a cross-linking agent is added in an amount of 1 to 10 parts by weight for 20 to 90 parts by weight of the water-soluble polymeric material based on the weight of the backcoat layer.

The cross-linking agent preferably comprises at least one member selected from the group consisting of dialdehyde compounds, for example, glyoxal and paraformaldehyde; polyamine compounds, for example, polyethyleneimine; epoxide compounds; polyamide compounds; melamine-formaldehyde resins; diglycidyl compounds, for example, glycerol diglycidylether; dimethylolurea compounds; aziridine compounds; block isocyanate compounds and cross-linking inorganic compounds, for example, ammonium persulfate, ferric chloride, magnesium chloride and zirconium ammonium carbonate.

The backcoat layer optionally comprises a pigment preferably having an average particle size of 5 μm or less, more preferably from 10 nm to 2,000 nm.

The pigment comprises at least one member selected from the group consisting of inorganic pigments, for example, calcium carbonate, magnesium carbonate, kaolin, clay, talc, anhydrous clay, silica, diatomaceous earth, synthetic aluminum silicate, zinc oxide, titanium dioxide, aluminum hydroxide, barium sulfate, and surface-coated or treated calcium carbonate and silica, and organic pigments, for example, urea-formaldehyde resins, styrene-methacrylic acid copolymer resins and polystyrene resins. Usually, the pigment is contained in an amount of 0 to 60%, preferably 10% to 50%, based on the total dry weight of the backcoat layer.

The antistatic agent comprises at least one member selected from, for example, alkali metal and ammonium salts of polystyrenesulfonic acid and polyacrylic acid, and contained preferably in an amount of 0 to 60%, more preferably 10 to 50%, based on the total dry weight of the backcoat layer.

The backcoat layer is formed by coating a coating liquid containing the above-mentioned materials on the opposite (back) surface of the substrate sheet by a customary coating method, for example, an air knife, mayer bar, blade, reverse roll or slit die coating method.

In the thermosensitive recording material of the present invention, a thermosensitive colored image-forming layer is formed on the front surface of the substrate sheet by the customary coating method as mentioned above.

Preferably, the surface of the thermosensitive colored image-forming layer is treated by a super calender, gloss calender or a machine calender, to smooth the surface and to enhance the color density and sensitivity of the colored images.

The thermosensitive colored image-forming layer preferably has a weight of 3 to 10 g/m$^2$, and comprises a substantially colorless dye precursor, a color-developing agent reactive with the dye precursor upon heating to develop a color, and a binder.

The substantially colorless dye precursor comprises at least one electron-donative color-forming compound, for example, fluoran compound selected from 2,2-bis{4-[6'-(N-cyclohexyl-N-methylamino)-3'-methyl-spiro(phthalide-3,9'-xanthene)-2'-ilamide]phenyl}propan, 3-diethylamino-6-methyl-7-anilinofluoran, 3-pyperidino-6-methyl-7-anilinofluoran, 3-(N-methyl-N-cyclohexylamino)-6-methyl-7-anilinofluoran, 3-diethylamino-7-chloroanilinofluoran, 3-[N-ethyl-N-(p-methylphenyl-)amino]-6-methyl-7-anilinofluoran, 3-diethylamino-7-(methatrifluoromethyl)anilinofluoran, 3-[N-ethyl-N-tetrahydrofurfryl]amino-6-methyl-7-anilinofluoran, 3-[N-ethyl-N-isopentyl]amino-6-methyl-7-anilino-fluoran, and 3-[N,N-dibutyl]amino-6-methyl-7-anilino-fluoran.

The color-developing agent comprises at least one electron-acceptive organic acid compound capable of being gasified or liquefied at room temperature or more, preferably upon heating at a temperature of 70° C. or more, and of reacting with the dye precursor upon heating to develop a color.

The color-developing agent usable for the present invention preferably comprises at least one member selected from phenolic compounds, for example, 4,4'-isopropylidene diphenol (bisphenol A), 4,4'-isopropylidene-bis(2-chlorophenol), 4,4'-isopropylidene-bis( 2-methylphenol), 4,4'-isopropylidene-bis(2,6-di-tertbutylphenol), 4,4'-sec-butylidene diphenol, 4,4'-cyclohexylidene diphenol, 4-tert-butylphenol, 4-phenylphenol, 4-hydroxydiphenoxide, 4,4'-dihydroxydiphenylsulfone, 2,4'-dihydroxydiphenylsulfone, 3,3'-dihydroxydiphenylsulfone, 3,3'-diamino-4,4'-dihydroxydiphenylsulfone, 3,3'-diallyl-4,4'-dihydroxydiphenylsulfone, 3,3'-dichloro-4,4'-dihydroxydiphenylsulfone, 4-hydroxydiphenylsulfone, 4-hydroxy-4'-isopropyl-diphenylsulfone, 4-hydroxy-4'-isopropyloxydiphenylsulfone, 2,4'-dihydroxydiphenylsulfone, 2,4'-dihydroxy-4'-methyldiphenylsulfone, and 3,4-dihydroxy-diphenyl-p-trisulfone.

Usually, the color-developing agent in the heat-sensitive color-forming layer is present in an amount of 1 to 5 parts by weight, preferably 1.5 to 3 parts by weight, per part by weight of the dye precursor.

The binder in the heat-sensitive color-forming layer comprises at least one polymeric material selected from the same water-soluble polymeric materials and water-insoluble polymeric materials as those usable for the backcoat layer, unless when mixed with aqueous dispersions of the dye precursor and of the developing agent the binder causes the resultant mixture to be colored, to be coagulated or to exhibit an increased viscosity. Also, preferably the binder effectively enhances the mechanical strength of the resultant thermosensitive colored image-forming layer, and does not cause an undesirable reduction of the thermosensitivity of the thermosensitive colored image-forming layer and an increase in the sticking property of the thermosensitive colored image-forming layer to the thermal head.

The thermosensitive colored image-forming layer optionally contains the same cross-linking agent as that used for the backcoat layer, to improve the water-resistance thereof.

Also, the thermosensitive colored image-forming layer optionally comprises at least one additive selected from, for example, customary white pigments, dispersing agents, antifoaming agents, fluorescent dyes and thermofusible substances.

The white pigment can be selected from the same inorganic and organic pigments as those usable for the backcoat layer, and is preferably used in an amount of 10 to 50% based on the total dry weight of the thermosensitive colored image-forming layer.

The dispersing agent, antifoaming agent and fluorescent dye can be selected from those usable for the conventional thermosensitive colored image-forming layer, and are used in a customary amount.

The thermofusible substance preferably has a melting point of from 80° C. to 110° C. and is selected from fatty acid amide, for example, stearic acid amide, stearic acid ethylene-bisamide, oleic amide, palmitic amide, coconut fatty acid amide, behenic amide; wax (or lubricant) materials, for example, calcium stearate, polyethylene waxes, carnauba wax, paraffin waxes, ester waxes; aromatic carboxylic esters, for example, dimethyl terephthalate ester, dibutyl terephthalate ester, dibenzyl terephthalate ester, dibutyl isophthalate ester, and phenyl 1-hydroxy-naphthoate ester; 1,2-di(3-methylphenoxy)ethane, 1,2-diphenoxy-ethane, 1-phenoxy-2-(4-methylphenoxy)ethane, diphenyl carbonate, p-benzyl biphenyl, hindered phenolic compounds, for example 2,2'-methylene-bis-(4-methyl-6-tert-butylphenol), 4,4'-butylidene bis(6-tert-butyl-3-methylphenol), 1,1,3-tris(2-methyl-4-hydroxy-5-tert-butyl-phenyl)butane, 2,2'-methylene bis(4-ethyl-6-tert-butylphenol), 2,4-di-tert-butyl-3-methylphenol, and 4,4'-thiobis(3-methyl-6-tert-butylphenol); sensitizing agents, for example, 2-(2'-hydroxy-5'-methylphenyl)benzotriazol and 2-hydroxy-4-bezyloxy-benzophenone; thermofusible lubricants, thermofusible antioxidants and thermofusible ultraviolet ray-absorbers.

The thermofusible substance is preferably employed in an amount of 4 parts by weight or less per part by weight of the color-developing agent.

In the formation of the thermosensitive colored image-forming layer, the coating liquid optionally contains a wetting agent, for example, acetylene glycol or a dialkylsulfosuccinic acid salt.

In an embodiment of the thermosensitive recording material of the present invention, the thermosensitive colored image-forming layer is optionally coated with an overcoat layer comprising 20% to 60% by weight of a pigment, 39% to 79% by weight of a binder resin, 1% to 10% by weight of a cross-linking agent and 0 to 40% by weight of a lubricant. Preferably, the overcoat layer has a weight of 1.0 to 5.0 g/m$^2$, more preferably 2.0 to 4.0 g/m$^2$. If the amount of the overcoat layer is less than 1.0 g/m$^2$, the resultant overcoat layer sometimes has an unsatisfactory uniformity and includes pinholes and coating defects. The pinholes and coating defects will allow an oily or fatty substance or plasticizer to penetrate the thermosensitive colored image-forming layer therethrough, and thus the resistance of the resultant image formed in the thermosensitive colored image-forming layer colored image to the oily or fatty substance or plasticizer is reduced. When the amount is more than 5 g/m$^2$, sometimes the resultant overcoat layer causes a decrease in thermosensitivity of the thermosensitive colored image-forming layer and a reduction in color density of the resultant colored images.

In the overcoat layer, preferably the binder resin and the pigment are present in a weight ratio of 80:20 to 40:60. If the weight ratio is more than 80:20, sometimes the resultant overcoat layer exhibits an undesirably increased stickiness, which results in a sticking of the recording sheets to a thermal head of a printer during a printing operation, and has an undesirably lowered bonding property to a printing ink in a labelling operation. If the weight ratio is less than 40:60, the resultant overcoat layer sometimes exhibits an unsatisfactory barrier effect against the oily or fatty substance or plasticizer, and thus the resultant colored images have a lower persistency. The pigment, binder resin, cross-linking agent and lubricant for the overcoat layer can be selected from those usable for the above-mentioned backcoat layer. Also, the overcoat layer can be formed in the same manner as that for the backcoat layer, as mentioned above.

The binder resin in the overcoat layer preferably comprises 10% to 100% by weight, more preferably 20% to 90% by weight,of a water-soluble polymeric material and 0 to 90% of weight, more preferably 10% to 80% by weight, of a water-insoluble polymeric material. The water-soluble and -insoluble polymeric materials can be selected from those used for the backcoat layer.

EXAMPLES

The present invention will be further explained by way of specific examples, which are merely representative and do not in any way restrict the scope of the present invention.

Examples 1 to 3

(1) Preparation of Substrate Sheet

In each of Examples 1 to 3, a synthetic paper sheet available under a trademark of Yupo FPG-80, from OJI YUKA GOSEISHI K.K., comprising a mixture of a polyolefin resin with an inorganic pigment, provided with a three-layer structure, and having a thickness of 80 μm, and a thermal shrinkage of 2.5% determined by heating at 120° C. for 30 minutes in the longitudinal direction thereof, was heat treated in the form of a wound roll under the conditions as shown in Table 1. The heat treated synthetic paper sheet exhibited a thermal shrinkage of 1.0 to 2.0% at 120° C. in the longitudinal and cross directions thereof as shown in Table 1.

(2) Preparation of a Coating Liquid for a Thermosensitive Colored Image-Forming Layer (A) An aqueous dye precursor dispersion (A) was prepared in the following composition.

| Component | Part by weight |
|---|---|
| 3-(N-methyl-N-cyclohexylamino)-6-methyl-7-anilinofluoran | 5 |
| 10% aqueous solution of a methylvinyl-ether-maleic anhydride copolymer | 5 |
| Water | 8 |

The composition was disperse-pulverized in an ultraviscomill until the average size of the pulverized particles became 1 μm or less.

(B) An aqueous color developing agent dispersion (B) was prepared in the following composition.

| Component | Part by weight |
|---|---|
| 2, 4-dihydroxy-diphenylsulfone | 30 |
| 10% aqueous solution of a methylvinyl-ether-maleic anhydride copolymer | 30 |
| Water | 22 |

The composition was dispersed and pulverized in an ultraviscomill until the average size of the pulverized particles became 1 μm or less.

(C) A coating liquid was prepared by mixing 30 parts by weight of the aqueous dye precursor dispersion A and 90 parts by weight of the aqueous color developing agent dispersion with 45 parts by weight of a 60% aqueous calcium carbonate slurry, 40 parts by weight of a 10% aqueous polyvinyl alcohol solution, 32 parts by weight of a styrene-butadiene rubber (SBR) latex (solid content: 50% by weight) and 70 parts by weight of water.

(3) Formation of a Thermosensitive Colored Image-Forming Layer.

The above-mentioned coating liquid was applied to a surface of the substrate sheet and dried to form a thermosensitive colored image-forming layer having a dry weight of 5.5 g/m$^2$.

(4) Formation of an Overcoat Layer

A coating liquid for an overcoat layer was prepared in the following composition.

| Component | Part by weight |
|---|---|
| Kaolinite clay aqueous slurry (Solid content: 60% by weight) | 40 |
| Modified polyvinyl alcohol aqueous solution (Solid content: 10% by weight) | 300 |
| Casein aqueous solution (Solid content: 10% by weight) | 200 |
| Zinc stearate aqueous dispersion (Solid content: 30% by weight) | 13 |
| Dimethylol urea aqueous solution (Solid content: 30% by weight) | 15 |
| Water | 300 |

The coating liquid was applied onto the surface of the thermosensitive colored image-forming layer, to form an overcoat layer with a dry weight of 3.0 g/m$^2$.

(5) Formation of a Backcoat Layer

A coating liquid for a backcoat layer was prepared in the following composition.

| Component | Part by weight |
|---|---|
| Casein aqueous solution (Solid content: 10% by weight) | 400 |
| Acrylic resin emulsion (Solid content: 44% by weight) | 45 |
| Kaolin aqueous slurry (Solid content: 60% by weight) | 58 |
| Zirconium ammonium carbonate (Solid content: 20% by weight) | 25 |
| Water | 139 |

The coating liquid was applied onto the opposite surface of the substrate sheet, to form a backcoat layer having a dry weight of 3.0 g/m$^2$.

(6) Calendering

The overcoat layer surface of the resultant recording sheet was calendered by a super calender to an extent such that the calendered surface exhibited a Bekk smoothness of 1,000 seconds to 1,200 seconds as indicated in Table 1, measured by an Ohken type smoothness tester (J. TAPPI, No. 6).

(7) Test

The resultant thermosensitive recording sheet was cut into A-4 size sheets, and the sheets were subjected to a thermal printing operation in a checkered pattern having dimensions of 1 cm×1 cm, using a customary thermal printer.

After the printing operation, the printed sheet was observed by the naked eye to evaluate a resistance of the recording sheet to cockling, and a degree of curling of the recording sheet was determined in the following manner.

The printed sheet was placed on a horizontal plane and height of apices of four corners of the sheet from the horizontal plane were measured. The degree of curling of the printed sheet was represented by an average value of the measured heights in mm.

The test results are shown in Table 1.

Examples 4 to 6

In each of Examples 4 to 6, a thermosensitive recording sheet was prepared and tested by the same procedures as in Example 1 with the following exceptions.

The substrate sheet was heat-treated under the conditions as shown in Table 1 and the resultant heat-treated substrate sheet exhibited the thermal shrinkages as shown in Table 1.

The coating liquid for the backcoat layer had the following composition.

| Component | Part by weight |
|---|---|
| Polyvinyl alcohol aqueous solution (Solid content: 10% by weight) | 300 |
| SBR latex (Solid content: 50% by weight) | 30 |
| Kaolin aqueous slurry (Solid content: 60% by weight) | 83 |
| Glyoxal (Solid content: 40% by weight) | 13 |
| Water | 74 |

The coating liquid was applied onto the opposite surface of the substrate sheet to form a backcoat layer with a dry weight of 2.0 g/m$^2$ in Example 4, 4.5 g/m$^2$ in Example 5, and 7.0 g/m$^2$ in Example 6.

The test results are shown in Table 1.

Examples 7 and 8

In each of Examples 7 and 8, a thermosensitive recording sheet was prepared and tested by the same procedures as in Example 1, with the following exceptions.

The substrate sheet was prepared by heat treating a thermoplastic resin film in the form of a wound roll, available under the trademark of Toyopal from Toyobo K.K.. having a thickness of 50 μm and a thermal shrinkage of 3.5% in the longitudinal direction thereof at 120° C. and comprising a polyethylene resin, at a temperature of 100° C. for 24 hours. The resultant heat treated film exhibited the thermal shrinkages as shown in Table 1.

In Example 7, the same coating liquid for the backcoat layer as in Example 1 was applied onto the opposite surface of the substrate sheet, to form a back layer having a weight of 3.0 g/m$^2$.

In Example 8, the same back layer-coating liquid as in Example 4 was applied in the same manner as in Example 7.

The test results are shown in Table 1.

Comparative Examples 1 and 2

In Comparative Example 1, a thermosensitive recording sheet was prepared and tested in the same manner as in Example 1, except that the substrate sheet consisting of the synthetic paper sheet Yupo FPG-80 was not heat-treated.

In Comparative Example 2, a thermosensitive recording sheet was prepared and tested in the same manner as in Example 7, except that the substrate sheet consisting of the thermoplastic film Toyopal was not heat-treated.

The test results are shown in Table 1.

Comparative Example 3

A thermosensitive recording sheet was produced and tested by the same procedures as in Example 7, except that the backcoat layer was formed in a small weight of 0.5 g/m$^2$.

The test results are shown in Table 1.

TABLE 1

| Example No. | Item | Heat treatment conditions Temperature (°C.) | Heat treatment conditions Time (day) | Thermal shrinkage of heat treated substrate sheet Longitudinal direction (%) | Thermal shrinkage of heat treated substrate sheet Cross direction (%) | Bekk smoothness of overcoat layer surface (sec.) | Printed sheet Cockling | Printed sheet Curling (mm) |
|---|---|---|---|---|---|---|---|---|
| Example | 1 | 90 | 1 | 1.8 | 0.9 | 1,200 | Substantially not cockled | — |
| | 2 | 90 | 3 | 1.3 | 0.7 | 1,000 | Substantially not cockled | 3 |
| | 3 | 100 | 1 | 1.6 | 0.8 | 1,100 | Substantially not cockled | 5 |
| Example | 4 | 90 | 1 | 1.8 | 0.9 | 1,150 | Slightly cockled | 13 |
| | 5 | 90 | 1 | 1.8 | 0.9 | 1,100 | Substantially not cockled | 9 |
| | 6 | 90 | 1 | 1.8 | 0.9 | 1,100 | Substantially not cockled | 6 |
| Example | 7 | 100 | 1 | 1.8 | 1.1 | 1,200 | Slightly cockled | 12 |
| | 8 | 100 | 1 | 1.8 | 1.1 | 1,200 | Slightly cockled | 18 |
| Comparative Example | 1 | — | — | 2.5 | 1.2 | 1,100 | Significantly cockled | 42 |
| | 2 | — | — | 3.5 | 2.8 | 1,100 | Significantly cockled | 55 |
| | 3 | 100 | 1 | 3.5 | 2.8 | 1,100 | Significantly cockled | 30 |

Table 1 clearly shows that the recording sheets of Examples 1 to 8 in accordance with the present invention exhibited a satisfactory resistance to cockling and curling in a thermal printing procedure, whereas the comparative recording sheets of Comparative Examples 1 to 3 were significantly cockled and curled by the thermal printing procedure.

We claim:

1. A thermosensitive recording material comprising:

a substrate sheet comprising at least one member selected from the group consisting of thermoplastic resin films and synthetic paper sheets having a multilayer structure;

a thermosensitive colored image-forming layer formed on a surface of the substrate sheet and comprising a substantially colorless dye precursor, a color-developing agent reactive with the dye precursor upon heating to develop a color, and a binder; and a backcoat layer formed on the opposite surface of the substrate sheet and comprising 20 to 90 parts by weight of a water-soluble polymeric material, 10 to 80 parts by weight of a water-insoluble polymeric material and 1 to 10 parts by weight of a cross-linking agent;

said substrate sheet exhibiting a thermal shrinkage restricted to a level of from 1.0% to 2.0% at a temperature of 120° C., and said backcoat layer having a weight of from 1 to 10 g/m$^2$.

2. The thermosensitive recording material as claimed in claim 1, wherein the thermoplastic resin films are selected from the group consisting of polyethylene, polypropylene, ethylene-vinyl acetate copolymer, polyvinyl chloride, polystyrene, and polyester resin films.

3. The thermosensitive recording material as claimed in claim 1, wherein the substrate sheet has a thickness of 50 to 500 μm.

4. The thermosensitive recording material as claimed in claim 1, wherein the water-soluble polymeric material comprises at least one member selected from the group consisting of polyvinyl alcohol resins, starch, modified starches, gum arabic, gelatin, casein, chitosan, methyl cellulose, hydroxyethyl cellulose, hydroxymethyl cellulose, polyvinyl pyrrolidone, polyacrylic acid salts, polyacrylamides, styrene-maleic anhydride copolymers, methylvinylether-maleic anhydride copolymers and isoprene-maleic anhydride copolymers.

5. The thermosensitive recording material as claimed in claim 1, wherein the water-insoluble polymeric material comprises at least one member selected from the group consisting of vinyl acetate-acrylic acid ester copolymers, polyurethane resins, polyvinyl chloride resins, polyvinylidene chloride resins, methacrylic acid ester copolymers and acrylic acid ester copolymers.

6. The thermosensitive recording material as claimed in claim 1, wherein the cross-linking agent comprises at least one member selected from the group consisting of dialdehyde compounds, polyamine compounds, epoxy compounds, polyamide resins, melamine-formaldehyde resins, diglycidyl compounds, dimethylol urea compounds, aziridine compounds, block isocyanate compounds, ammonium persulfate, ferric chloride and magnesium chloride, said cross-linking agent being present in an amount of from 1% to 10% based on the weight of the backcoat layer.

7. The thermosensitive recording material as claimed in claim 1, wherein the backcoat layer further comprises at least one additive selected from the group consisting of pigments and antistatic agents.

8. The thermosensitive recording material as claimed in claim 1, further comprising an overcoat layer formed on the thermosensitive colored image-forming layer, and comprising 20% to 60% by weight of a pigment, 40% to 80% by weight of a binder resin, 0.5% to 10% by weight of a cross-linking agent, and 0 to 39.5% of a lubricant.

9. The thermosensitive recording material as claimed in claim 8, wherein the overcoat layer has a weight of 1.0 to 5.0 $g/m^2$.

10. The thermosensitive recording material as claimed in claim 8, wherein the binder resin and the pigment in the overcoat layer are present in a weight ratio of 80:20 to 40:60.

11. The thermosensitive recording material as claimed in claim 8, wherein the binder resin in the overcoat layer comprises 50% to 100% by weight of a water-soluble polymeric material and 0 to 50% by weight of a water-insoluble polymeric material.

* * * * *